United States Patent [19]

Herrmann, Jr. et al.

[11] 3,999,830

[45] Dec. 28, 1976

[54] HIGH VOLTAGE CONNECTOR WITH BIFURCATED METAL SHELL

[75] Inventors: Henry Otto Herrmann, Jr., Mount Joy; Douglas Wade Glover, Harrisburg, both of Pa.

[73] Assignee: AMP Incorporated, Harrisburg, Pa.

[22] Filed: July 18, 1975

[21] Appl. No.: 597,121

[52] U.S. Cl. ..... 339/136 M; 339/132 R; 339/141

[51] Int. Cl.[2] ..... H01R 13/46

[58] Field of Search ..... 339/92, 94 A, 103 C, 339/107, 119 R, 49 R, 125 R, 126 R, 134, 136 RM, 132 R, 132 B, 138, 139 R, 141

[56] References Cited

UNITED STATES PATENTS

| | | | |
|---|---|---|---|
| 2,700,140 | 1/1955 | Phillips | 339/136 M X |
| 3,030,602 | 4/1962 | Jackson et al. | 339/136 M X |
| 3,467,942 | 9/1969 | Dell et al. | 339/49 R |
| 3,745,512 | 7/1973 | Johnson et al. | 339/126 |
| 3,790,922 | 2/1974 | Normann | 339/138 X |

*Primary Examiner*—Roy Lake
*Assistant Examiner*—E. F. Desmond
*Attorney, Agent, or Firm*—Gerald K. Kita

[57] ABSTRACT

An electrical connector having a dielectric housing and a plurality of internal cavities containing electrical contacts terminated to electrical leads which protrude from the housing is contained within a conductive shell. The shell is bifurcated longitudinally with each shell portion having a lip which interlocks on the dielectric housing when the shell portions are assembled together. Each shell portion includes a pair of flanges on opposite sides. The flanges project outwardly toward an open side of the shell portion to captivate the other shell portion. The flanges also are in laterally offset planes such that the shell portions are identical and when they are assembled their corresponding flanges are overlapped. Fasteners may be used to join the overlapped flanges. Also mounting bolts and the like may be assembled on the overlapped flanges for mounting the shell to a bulkhead or panel. Electrical leads protruding from the assembled shell may be encapsulated within the shell. Alternatively a metal outer sheath of the leads may be compressibly stuffed into a groove of the shell by a rigid metal ring.

6 Claims, 5 Drawing Figures

HIGH VOLTAGE CONNECTOR WITH BIFURCATED METAL SHELL

FIELD OF THE INVENTION

The present invention relates to a connector for high voltage electrical leads and electrical contacts provided with a rugged metal shell advantageously fabricated in two identical parts and assembled over the completed dielectric housing of the connector.

SUMMARY OF THE INVENTION

An electrical connector having a dielectric housing and a plurality of internal cavities containing electrical contacts terminated to electrical leads which protrude from the housing is contained within a conductive shell. The shell is bifurcated longitudinally with each shell portion having a lip which interlocks on the dielectric housing when the shell portions are assembled together. Each shell portion includes a pair of flanges on opposite sides. The flanges project outwardly toward an open side of the shell portion to captivate the other shell portion. The flanges also are in laterally offset planes such that the shell portions are identical and when they are assembled the corresponding flanges are overlapped. Fasteners may be used to join the overlapped flanges. Also mounting bolts and the like may be assembled on the overlapped flanges for mounting the shell to a bulkhead or panel.

Electrical leads protruding from the assembled shell may be encapsulated within the shell. Alternatively a metal outer sheath of the leads may be compressibly stuffed into a groove of the shell by a rigid metal ring.

OBJECTS

It is accordingly an object of the present invention to provide an electrical connector for high voltage electrical leads and contacts with a rugged metal shell assembleable over the completely assembled connector.

Another object of the present invention is to provide a high voltage electrical connector for high voltage electrical leads and contacts with a metal shell in bifurcated form.

Another object of the present invention is to provide an electrical connector for high voltage electrical leads and contacts with a rugged metal shell capable of assembly to the completely assembled connector and which utilizes a rigid metal ring for grounding a conductive sheath of the electrical leads to the shell.

Other objects and many attendant advantages of the present invention will become apparent upon perusal of the following detailed description taken in conjunction with the drawings.

DETAILED DESCRIPTION OF THE INVENTION

Figure 2:
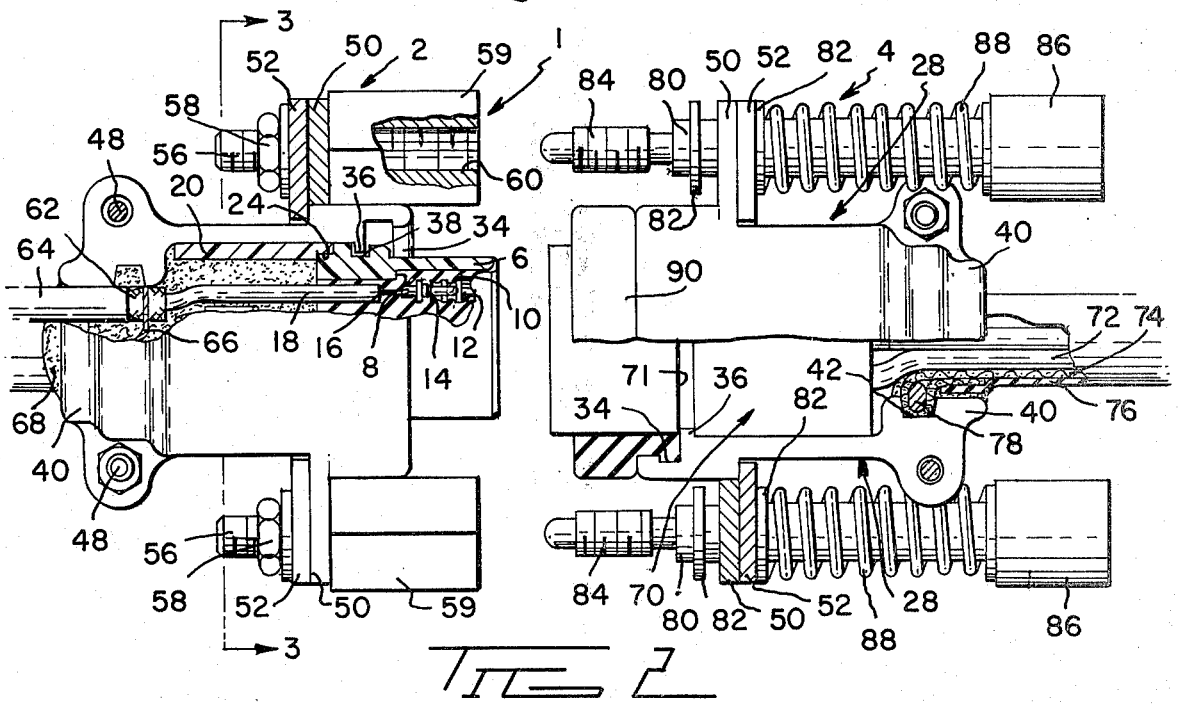
FIG. 2 is an elevation with parts broken away and with parts in section illustrating mating plug and receptacle connector portions provided with metal shells according to the present invention.
Figure 3:
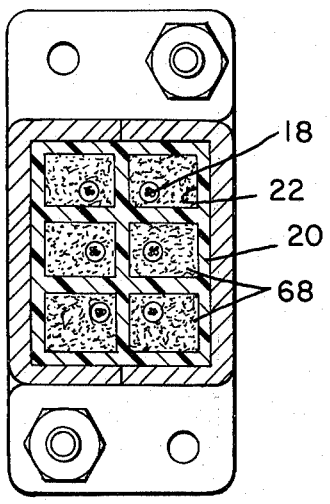
FIG. 3 is a section taken along the line 3—3 of FIG. 2.
Figure 4:
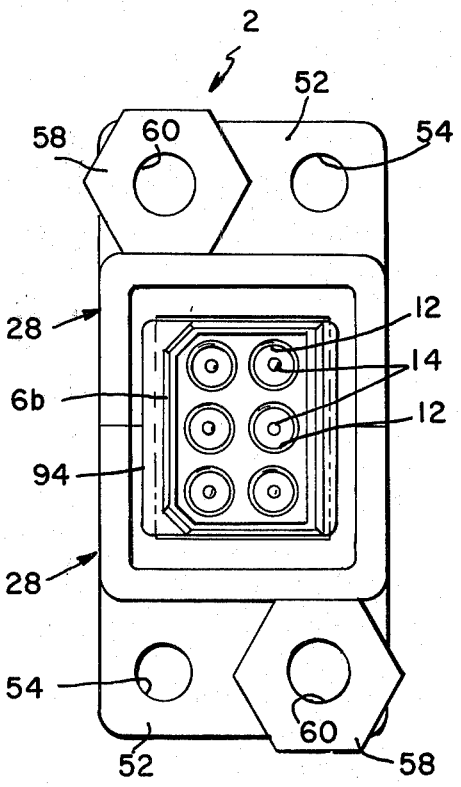
FIG. 4 is an end elevation of an alternative plug portion of the connector.

With more particular reference to the drawings there is illustrated in FIGS. 2 and 4 an electrical connector 1 comprising a plug portion 2 and a receptacle portion 4. The plug portion 2 includes a rigid dielectric housing 6 having an internal step portion or shoulder 8. A molded silicone insert 10 is resiliently press fit within the housing 6 in seated registration on the shoulder 8. The insert 10 includes a plurality of molded cavities 12 in which are seated corresponding high voltage electrical contacts 14 in the form of pins. The contacts 14 are terminated to high voltage electrical conductors 16 encircled by an insulation sheath 18. The terminated leads and contacts are advantageously forcibly inserted within the resilient silicone insert using RTV silicone as a lubricant and as an adhesive cementing the leads in place within the insert 10. As shown the leads 18 protrude from the insert 10 and the dielectric housing 6. To maintain separation between the protruding leads 18 a dielectric cellular shell 20 is illustrated in FIGS. 2 and 3. The shell 20 has a plurality of enlarged cavities 22 receiving a protruding lead 18 therethrough. The shell 20 is provided with an internal shoulder 24 at one end thereof for seated registration against an end of the rigid housing 6. Dielectric encapsulant such as epoxy 25 fills the shell cavities sealably encapsulating the leads. The plug portion 2 of the connector thereby is completely assembled according to specified assembly techniques.

Figure 1:
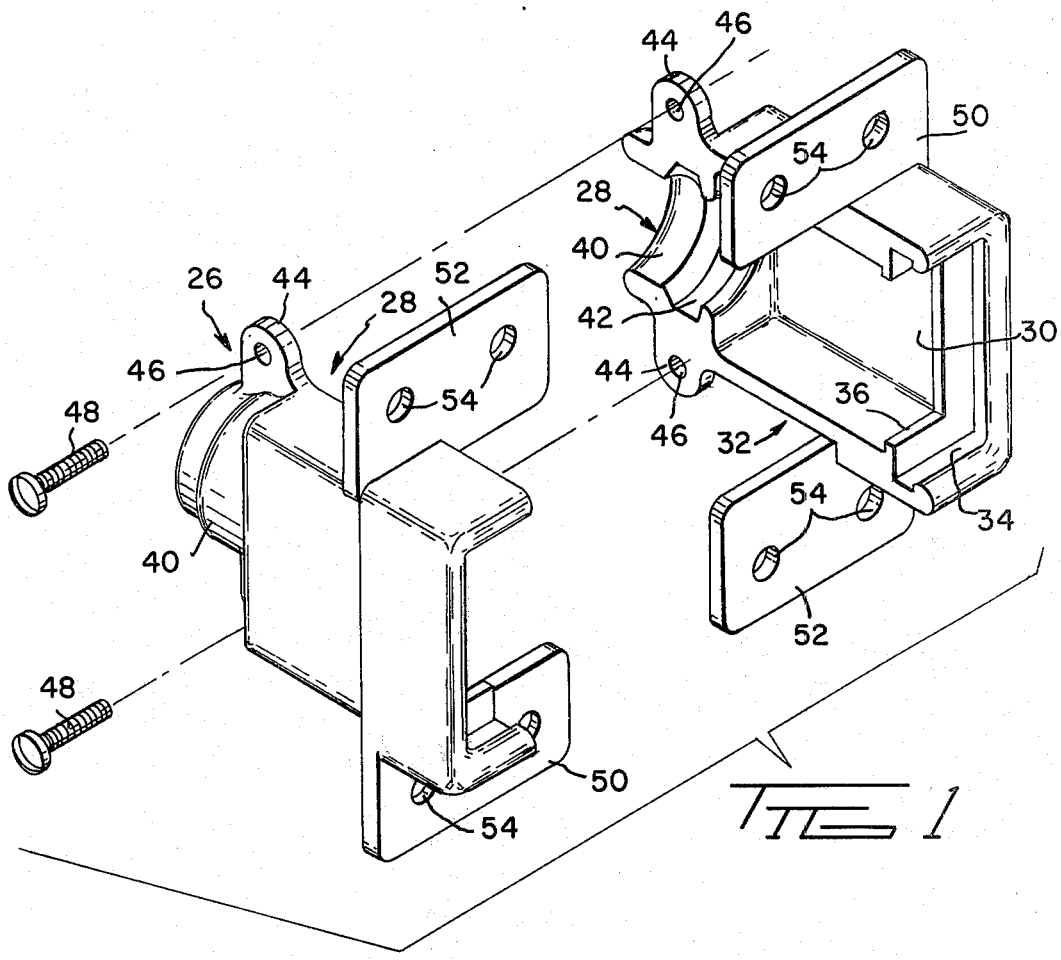
FIG. 1 is an enlarged perspective with parts in exploded configuration illustrating a bifurcated metal shell capable of assembly over a high voltage electrical connector.

To adapt a protective metal shell for the connector portion it is not necessary to change the assembled connector or the assembly procedures. According to the present invention the rugged metal shell is adapted for assembly over the completely assembled connector and is of the form illustrated in FIG. 1. The shell 26 is in bifurcate form having two identical metal castings each illustrated generally at 28 which are assembled together in mating relationship to form the completed shell. Each shell portion 28 includes an internal cavity 30 which is defined by sidewalls of the shell portion and which has a longitudinal side 32 thereof which is open. The cavity 30 is adaptd to conform to the exterior of the assembled housing 6 and shell 20. An open end 34 of the shell portion 28 communicates with the internal cavity 30. The housing 6 protrudes from the open end 34 when each shell portion 28 is assembled thereover. Each shell portion 28 further includes an inwardly projecting lip 36 which registers within a corresponding groove 38 encircling the exterior of the housing 6 thereby captivating the housing 6 in place. The remaining end 40 of each shell portion 28 defines a reduced dimension opening communicating with the cavity 30. The leads 18 protruding from the housing 6 and shell 20 are received through the openings in the end 40 and are bundled or gathered together thereby. The end 40 is provided with an internal groove 42 in alignment with oppositely projecting external flanges 44 which are in turn provided with apertures 46 into which fasteners 48 are received during assembly of the shell portions 28 to each other. On opposite sides of each shell portion 28 is provided outwardly projecting flanges 50 and 52. The flanges also project outwardly past the open side 32 toward the other shell portion 28 such that upon assembly of the two shell portions 28 together the flanges 50 and 52 of one shell portion will captivate therebetween the other shell portion 28. It is also noted that the flanges 50 and 52 of each shell portion 28 are disposed in offset and adjacent planes enabling the shell portions 28 to be identical, that is, fabricated from the same casting. When the two shell portions 28 are assembled together the flange 50 of a first shell portion will overlie the flange 52 of the second shell portion 28. In similar fashion the flange 52 of a first shell portion 28 will be overlied by the flange 50 of the second shell portion 28. The overlapping flanges are provided with aligned fastener positions defined by mounting apertures 54 which receive elongated threaded fasteners 56 therein. The fasteners 56 include enlarged hexagonal heads 58 which are provided with internally threaded recesses 60. The terminated leads 18 project through the end 40 of the shell portions 28 as shown in FIG. 2. The leads are each covered with an outer conductive sheath or braid 62 which is in turn contained within an outer dielectric cover 64. A portion of the sheath 62 is exposed by cutting away a portion of the cover 64 such that the exposed sheath 62 is contained within the end 40 of the shell portion 28. A wire 66 is utilized to bond or to bundle together the exposed braid portions 62 of each lead 18 and to ground the same to the shell portions 28. The end 40 of the shell is then filled with a conductive encapsulant material such as conductive epoxy which encircles the terminated leads and mechanically affixes them in place and electrically grounds the portions 62 to the shell portions 28. The epoxy 68 completely fills the end portion 40 of the mated together shell portions 28 and also sealably engages the epoxy in the cavities 22 of the shell portion 20 as shown in FIG. 3.

FIG. 2 illustrates the receptacle portion of the connector wherein mating shell portions 28 encircle and captivate a dielectric receptacle housing 70 containing therein electrical contact receptacles (not shown) for mated electrical connection with the contacts 14. The receptacle contacts are terminated to high voltage electrical leads 72 which protrude from the housing and through the open end 40 of each shell portion 28. A groove 71 in the housing 70 receives the lips 36 and captivates the housing in place. The leads 72 are collectively bundled within a single encircling outer conductive sheath 74 in turn contained within an outer jacket of dielectric 76. The conductive sheath 74 is encircled about a rigid metal ring 78 which is received within the groove 42 of each shell portion 28. Upon connecting together the shell portions 28 the metal ring is compressibly stuffed within the groove portions 42 thereby compressing the encircling sheath 74 against the shell portions 28 and thereby grounding the shell portions to the conductive sheath 74. The overlapping flange portions 50 and 52 of the connected together shell portion 28 receive elongated shafts 80 freely therethrough and the shafts are provided with snap on rings 82 serving as keepers for the shafts 80. One end 84 of each shaft is externally threaded for threaded connection within the threaded recesses 60 or for connection to a bulkhead or panel. The other end of each shaft 80 is provided with an enlarged integral head 86 and a resilient spring 88 encircles the shaft and is positioned between the end 86 and the overlapped flanges 50 and 52. The spring 88 assists in removal of the threaded ends 84 when threadably unfastening the same from the enlarged heads 58. When mating the connector portions together the housing 6 will be received in the housing 70. An enlarged resilient rubber ring or gasket 90 encircles the receptacle housing 70 and is resiliently force-fit into the grooved front end 34 of each shell portion 28. The gasket 90 serves as a seal engaged between the respective shell portions 28 of the connectors.

Figure 5:
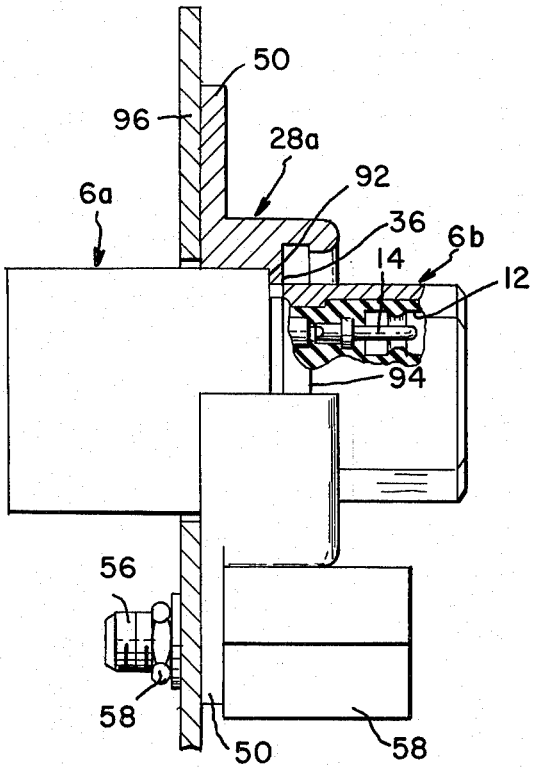
FIG. 5 is an elevation partially in section and partially with parts broken away of an alternative plug portion according to the present invention.

An alternative connector portion is illustrated in FIG. 5. A modified housing *6a* is illustrated which eliminates the groove 38 of housing 6 and instead provides a reduced stepped portion 66 providing only a shoulder 92 which is stopped against the inwardly projecting flange 36 of each shell portion *28a*. Each shell portion *28a* is modified to eliminate the rearward end portion 40. In addition the flanges 50 thereof are coplanar rather than offset planar as in the embodiment of the shell portion shown in FIG. 1. The reduced portion *6b* of the housing has outwardly projecting flanges 94 engaging the flange 36 to captivate the housing in place within the modified shell portion *28a*. The flanges 50 are mounted removably to a bulkhead or panel 96.

What has been illustrated and described are preferred embodiments and modifications of the present invention. Other modifications and embodiments thereof are intended to be covered by the spirit and scope of the appended claims.

What is claimed is:

1. In an electrical connector having a dielectric housing and a plurality of internal cavities containing electrical contacts terminated to electrical leads which protrude from the housing, the combination comprising:

a conductive shell comprised of two shell portions clamped together in encirclement on said housing, each said shell portion having an open side and an integral lip facing said open side and interfitting with a groove in a side of said housing, a pair of flange portions provided with fastener retaining means, said flange portions being in laterally offset and adjacent planes on opposite sides of each said shell portion such that when said shell portions encircle said housing said flange portions are overlapped with the fastener retaining means thereof in alignment.

2. The structure as recited in claim 1, wherein, said flange portions of each said shell portion project outwardly toward the other shell portion and captivate therebetween said other shell portion when said shell portions are clamped together.

3. The structure as recited in claim 1 and further including:

fastener means in said flanges fastening said shell portions together, said fastener means having projecting mounting means for mounting said connector to a bulkhead or to another connector.

4. The structure as recited in claim 1, wherein, each said shell portion includes a groove, a conductive sheath encircling said electrical leads and compressibly received in said groove grounding said sheath to said shell.

5. The structure as recited in claim 4, and further including: a ring of rigid material in said groove compressing said sheath in said groove.

6. The structure as recited in claim 1, and further including: dielectric encapsulating material in said shell encircling said leads.

* * * * *